US007395824B2

(12) United States Patent
Wen et al.

(10) Patent No.: US 7,395,824 B2
(45) Date of Patent: Jul. 8, 2008

(54) CLEANING APPARATUS FOR PILLARED DEVICES

(75) Inventors: Tien-Kuei Wen, Hsinchu (TW); Bin-Lin Chang, Pa Teh (TW)

(73) Assignee: AU Optronics Corp., Hsinchu (TW)

( * ) Notice: Subject to any disclaimer, the term of this patent is extended or adjusted under 35 U.S.C. 154(b) by 471 days.

(21) Appl. No.: 10/722,513

(22) Filed: Nov. 28, 2003

(65) Prior Publication Data

US 2005/0039786 A1 Feb. 24, 2005

(30) Foreign Application Priority Data

Aug. 22, 2003 (TW) ..... 92123204 A

(51) Int. Cl.
*B08B 3/02* (2006.01)

(52) U.S. Cl. ..... 134/64 R; 64/122 R; 64/199

(58) Field of Classification Search ..... 134/64 R, 134/122 R, 199
See application file for complete search history.

(56) References Cited

U.S. PATENT DOCUMENTS 584,988 A * 6/1897 Clement ..... 266/134
1,458,384 A * 6/1923 Bathke ..... 134/199
1,676,825 A * 7/1928 Haase ..... 15/40
1,910,497 A * 5/1933 Peik ..... 451/89
2,009,078 A * 7/1935 Ziska ..... 148/590
2,287,825 A * 6/1942 Postlewaite ..... 134/114
2,322,417 A * 6/1943 Christian ..... 134/60
2,422,757 A * 6/1947 Swift ..... 144/208.3
2,526,542 A * 10/1950 Davies ..... 15/88
2,565,855 A * 8/1951 Jordan ..... 134/64 R
2,576,861 A * 11/1951 Shaw et al. ..... 144/208.3
2,651,312 A * 9/1953 McBeth ..... 134/122 R
2,681,069 A * 6/1954 Marshall et al. ..... 134/175
2,685,293 A * 8/1954 Dauphinee et al. ..... 134/153
2,900,991 A * 9/1959 Arnold ..... 134/64 R
3,092,123 A * 6/1963 Harris ..... 134/61
3,323,528 A * 6/1967 Link ..... 134/57 R
3,559,558 A * 2/1971 Hamlin et al. ..... 396/609

(Continued)

FOREIGN PATENT DOCUMENTS

JP 60-12186 * 6/1985

(Continued)

OTHER PUBLICATIONS

European Patent Office 0 204 655 Apr. 1986.*

(Continued)

*Primary Examiner*—Frankie L. Stinson
(74) *Attorney, Agent, or Firm*—Troxell Law Office, PLLC

(57) ABSTRACT

A cleaning apparatus for pillared device comprises an outer tank, an inner tank, a lid and a plurality of nozzles. Upper edges of opposing sidewalls of the outer tank include respective openings to support a shaft extending out from two ends of the pillared device. The inner tank within the outer tank for containing a first cleaning solution to dip a portion of the pillared device is constructed above the floor of the outer tank. The lid is rested on the top of the outer tank. The nozzles constructed along a pipeline inside the lid is used to spay a second cleaning solution onto the pillared device mounted in the inner tank.

7 Claims, 3 Drawing Sheets

U.S. PATENT DOCUMENTS

| | | | | | |
|---|---|---|---|---|---|
| 3,625,131 | A | * | 12/1971 | Puls | 396/606 |
| 3,986,710 | A | * | 10/1976 | Day et al. | 266/129 |
| 4,469,526 | A | * | 9/1984 | Budinsky et al. | 134/25.4 |
| 5,159,734 | A | * | 11/1992 | Whitt et al. | 15/88.3 |
| 5,191,532 | A | | 3/1993 | Moroto et al. | 364/449 |
| 5,291,827 | A | * | 3/1994 | Liers et al. | 101/424 |
| 5,366,584 | A | * | 11/1994 | Zukowski et al. | 216/92 |
| 5,490,460 | A | * | 2/1996 | Soble et al. | 101/424 |
| 5,606,394 | A | * | 2/1997 | Nomura et al. | 355/27 |
| 5,636,571 | A | * | 6/1997 | Abrahamson | 101/424 |
| 5,692,188 | A | * | 11/1997 | Watts et al. | 396/634 |
| 5,819,200 | A | | 10/1998 | Tamai et al. | 701/208 |
| 6,234,080 | B1 | * | 5/2001 | Tani | 101/424 |
| 6,460,967 | B1 | * | 10/2002 | Makita et al. | 347/33 |

FOREIGN PATENT DOCUMENTS

| | | | |
|---|---|---|---|
| JP | 6-122191 | * | 5/1994 |
| JP | 6-330269 | * | 11/1994 |
| JP | 7-224365 | * | 8/1995 |
| JP | 08-304099 | | 11/1996 |
| JP | 9-268384 | * | 10/1997 |

OTHER PUBLICATIONS

European Patent Office 0 204 655 Dec. 1986.*

* cited by examiner

CLEANING APPARATUS FOR PILLARED DEVICES

FIELD OF THE INVENTION

The present invention relates to a cleaning apparatus for pillared device, and more particularly to a cleaning apparatus for carrying out two cleaning procedures upon the pillared device.

DESCRIPTION OF THE PRIOR ART

Thin polyimide (PI) film is one of the most commonly employed alignment films to align liquid crystal (LC) molecules with predetermined pre-tilts. In the art, a proper orientation relationship between the liquid crystal molecules and the orientation layer will benefit to achieve a lower addressing voltage of the pixels in the LC display. However, when the PI film is rubbed by a velvet cloth, microscopic groves are usually generated on the PI layer and make the molecules line up along the rubbing direction. Such an damage may cause the angular arrangement of the surface liquid crystals into an unexpected pattern, for example a twisted or a helical pattern, for sustaining basic paralleling among LC molecules.

Referring to FIGS. 1A to 1C, a polyimide solution carried by a roller 10 is coated onto a transparent electrode 52, i.e. an indium tin oxide (ITO), rested on a glass substrate 50. Then, the polyimide solution on the transparent electrode 52 is firstly pre-baked to transform into a gel polyimide film 30. Further, the gel polyimide film 30 is baked at a temperature of 200 to 300° C. for 10 to 30 minutes, for forming a solid polyimide film 54.

When the roller 10 for coating the polyimide is used for a period of time, crystals of the polyimide may residue on the roller 10 by static electricity , which the residual crystals will result in various imprints on the roller and which the imprints will lead to damage the transparent electrode 52.

In general, the roller 10 with a substantial amount of the imprints is no more usable and needs to be sent back to its original manufacturer for necessary cleaning and maintenance. Definitely, such a management upon an imprinted roller 10 will sacrifice both the service time and manufacturing cost.

In the art, an organic solvent, e.g. an N-methyl-2 pyrrolidinone (NMP), can be applied to solve part of the problem on the roller 10 described above, yet the imprints thereon can not be really removed. If the roller 10 is re-used to coat the polyimide solution on the transparent electrode 52, the thickness of the polyimide film will be unstable and a phenomenon of color mura will be generated.

It is noted that an alkali, such as a potassium peroxide, can be used to remove the imprints completely. In the present process, however, no appropriate platforms can be applied to clean a pillared device with an alkali/acid. In addition, the alkali/acid is highly harmful to operators if the pillared device is cleaned by artificially wiping up the particles adhere thereto. Therefore, the performance and setup of the cleaning process by using alkali/acid can be better controlled for sure by an appropriate apparatus.

SUMMARY OF THE INVENTION

Accordingly, an object of the present invention is to provide a cleaning apparatus for pillared devices.

Another object of the present invention is to provide a cleaning apparatus for performing two cleaning procedures to pillared devices.

A cleaning apparatus of the present invention can comprise an outer tank, an inner tank, a removable lid and a plurality of nozzles. Upper edges of opposing sidewalls of the outer tank include respective openings. The inner tank for containing a first cleaning solution is located within the outer tank. Rested on a top of the outer tank is the removable lid. The nozzles are constructed in the interior of the lid to spray a second cleaning solution directly onto a pillared device.

The present invention can also disclose a method of cleaning the pillared device by using the above cleaning apparatus. Firstly, at least a portion of the pillared device is dipped into the first cleaning solution in the inner tank, with a shaft protruding from two ends of the pillared device to pass through the openings of the outer tank. Next, the lid covers the top of the outer tank. When the shaft is turned, the pillared device can rotate to react with the first cleaning solution. The first cleaning solution is released out of the first cleaning tank after cleaning the pillared device. Lastly, a second cleaning solution from the nozzles is sprayed directly onto the pillared device to dilute the remained first cleaning solution.

BRIEF DESCRIPTION OF THE DRAWINGS

The foregoing aspects and many of the attendant advantages of this invention will become more readily appreciated and understood by referencing the following detailed description in conjunction with the accompanying drawings, wherein.

DETAILED DESCRIPTION OF THE PERFERRED EMBODIMENTS

The invention disclosed herein is directed to a cleaning apparatus for pillared devices. Also, the invention is further directed to a method of cleaning the pillared devices by using the cleaning apparatus. A preferred embodiment of the present invention is now described in detail below.

Figure 1A:
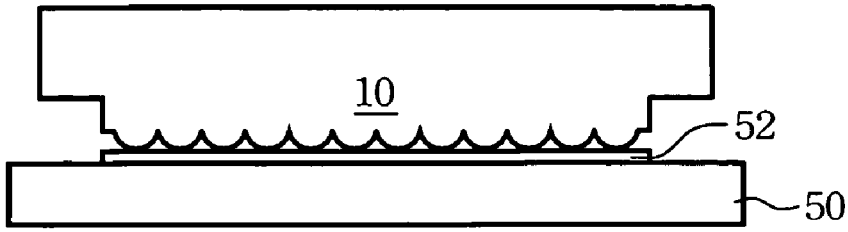
FIG. 1A (Prior Art)
FIG. 1A is a schematic diagram of coating the polyimide solution onto a transparent electrode by using a roller in accordance with the prior art.
Figure 1B:
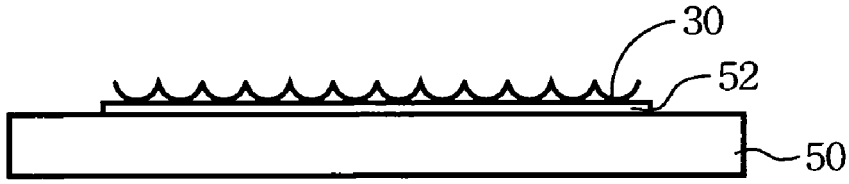
FIG. 1B (Prior Art)
FIG. 1B is a schematic diagram of performing a pre-baking to the polyimide solution in accordance with the prior art.
Figure 1C:
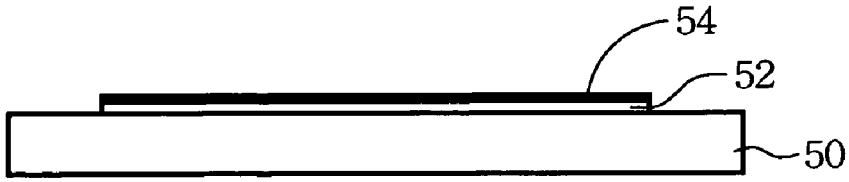
FIG. 1C (Prior Art)
FIG. 1C is a schematic diagram of performing a baking to the polyimide film in accordance with the prior art.
Figure 2:
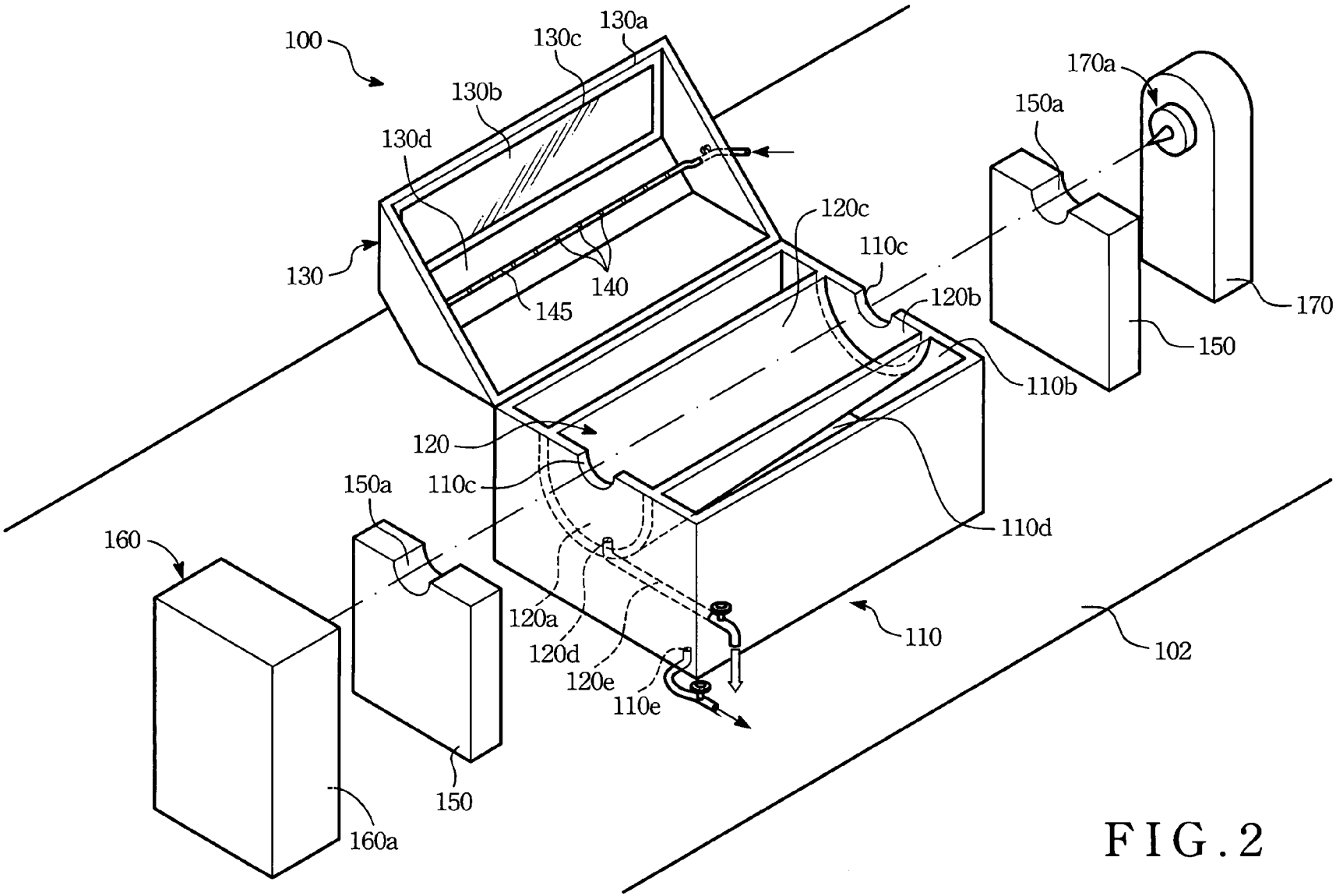
FIG. 2 is a perspective side view of a preferred cleaning apparatus in accordance with the present invention.

Referring to FIG. 2, a preferred cleaning apparatus 100 can comprise a base 102, an outer tank 110, an inner tank 120, a removable lid 130, a plurality of nozzles 140, a set of bolsters 150, a motor 160 and a tail stock 170. The outer tank 110 is disposed upon the base 102, in which upper edges of opposing sidewalls, 110*a* and 110*b*, of the outer tank 110 further include respective first openings 110*c*. The first openings 110*c* can allow a shaft extending out from two ends of a pillared device (not shown) to pass through. In the embodiment of the present invention as shown, the opening 110*c* is preferably arched. Definitely, in other embodiments of the present invention not shown here, the profile of the opening can be a half-oval, a half-circle, or any shape that can be applied to sustain the extending shaft of the pillared device.

Also, in the present invention, the pillared device can be an optoelectrical device, a solid shaft, or any having a pillar shape.

The inner tank 120 positioned within the outer tank 110 is used to contain the pillared device. When the cleaning apparatus 100 performs a cleaning process to the pillared device, a first cleaning solution is poured into the inner tank 120. In one preferred embodiment of the present invention, the inner tank 120 can be a semi-cylindrical shell so as to minimize the amount of the first cleaning solution. Still referring to FIG. 2, opposing sidewalls 120*a* and 120*b* of the inner tank 120 can be formed as parts of sidewalls 110*a* and 110*b*. Also, the inner tank 120 is supported above the floor 110*d* of the outer tank 110.

Figure 3:
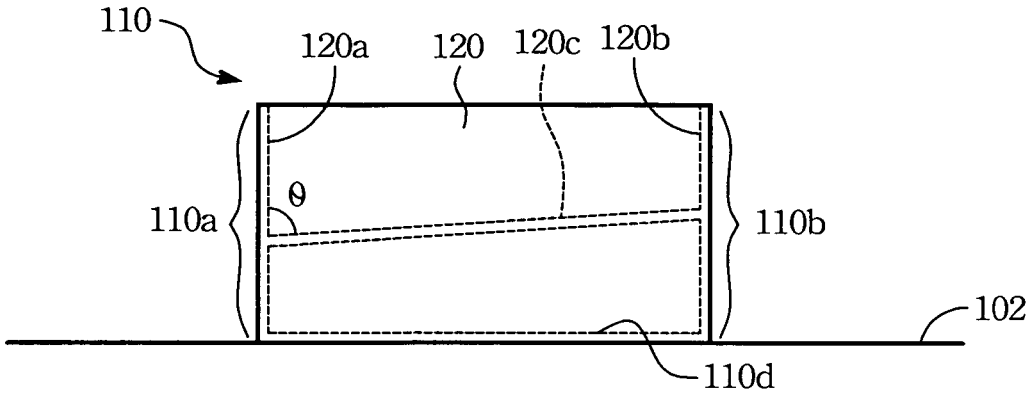
FIG. 3 is a side view showing an outer tank and an inner tank in accordance with the present invention.

Referring to FIG. 3, between the bottom 120*c* and the sidewall 120*a* exists an angle θ since the area of the sidewall 120*a* is deeper than that of the sidewall 120*b*. Now back to FIG. 2, a first outlet 120*d* is located between the bottom 120*c* and the sidewall 120*a*. One end of a conduit 120*e* is connected with the first outlet 120*d*, whereas the other end of the conduit 120*e* is extended down out of the outer tank 110. Upon such an arrangement, the first cleaning solution in the inner tank 120 can be released out of the outer tank 110 through the first outlet 120*d* and the conduit 120*e* after cleaning the pillared device.

In a preferred embodiment of the present invention, the level of the base 102 can be adjusted and a second outlet 110*e* can be created at a low-lying area of the floor 110*d*, so that the cleaning solutions in the outer tank 110 can be discharged therethrough.

As shown in FIG. 2, the lid 130 can be moved to cover the top of the outer tank 110. On a sidewall 130*a* of the lid 130, a transparent window 130*b* can be included to allow operators to monitor the proceeding of the cleaning process. In one embodiment of the present invention, a sealant can be further utilized at the conjunctions between the transparent window 130*b* and the sidewall 130*a* so as to prevent cleaning solutions within the cleaning apparatus 100 from leaking out therethrough while performing the cleaning process.

A piping 145 passing through the lid 130 is constructed high in the interior 130*d* thereof and has a plurality of nozzles 140 spaced therealong. Hence, the cleaning solution can flow into the cleaning apparatus 100 through the piping 145 and thereafter sprays onto the pillared device directly via the nozzles 140.

Figure 4:
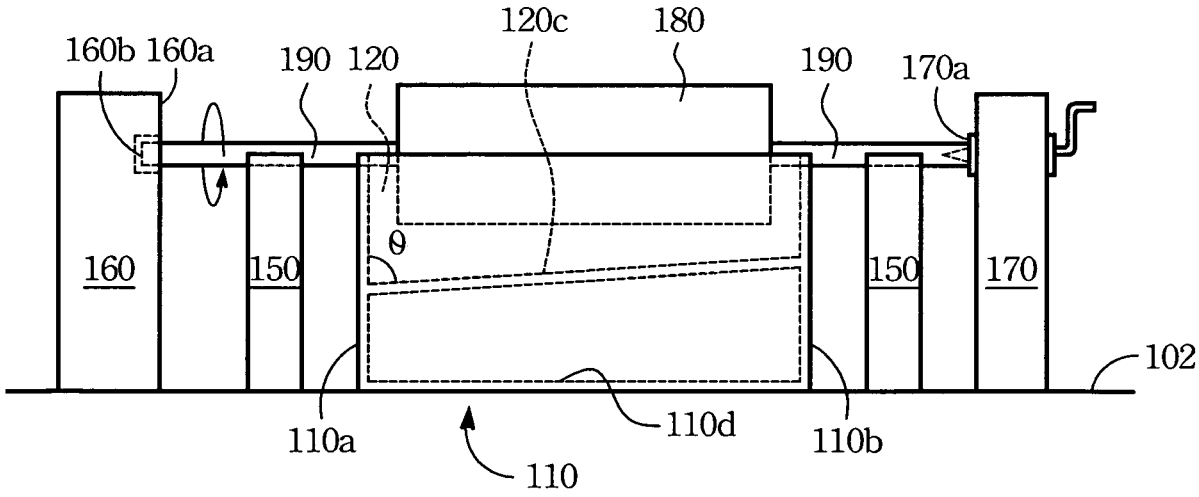
FIG. 4 is a side view showing a pillared device mounted on the cleaning apparatus in accordance with the present invention.

Referring to FIG. 4 and FIG. 2, a set of bolsters 150 are disposed upon the base 102 and flank the outer tank 110. In other words, the outer tank 110 is located between the bolsters 150. Upper edges of opposing bolsters 150 are seen to include respective second openings 150*c* for supporting the shaft 190 of the pillared device 180 mentioned above.

A motor 160 and a tail stock 170 are constructed further on the base 102 by having the outer tank 110 and the supports 150 position in between. As shown in FIG. 4, one end of the shaft 190 is stuck into a driving portion 160*b* constructed on a sidewall 160*a* of the motor 160, and the other end of the shaft 190 pairs a dead center 170*a* of the tail stock 170 so that the shaft 190 can turn with the driving portion 160*b*.

The present invention also provides a preferred method of cleaning the pillared device 180 respective to the aforesaid cleaning apparatus 100. Firstly, the pillared device 180 is immersed into a first solution in the inner tank 120, wherein a shaft 190 extending out from two ends of the pillared device 180 passes through the first openings 110*c* and the second openings 150*a* and is further supported by the bolsters 150. It is noted that at least a potion of the pillared device 180 is immersed into the first cleaning solution. One end of the shaft 190 is stuck into the driving portion 160*b* and the other end thereof tipped by the dead center 170*a* of the tail stock 170. In the present invention, the pillared device 180 can be a roller used for coating an alignment film over a glass substrate described above, a taped shaft, or any that has a pillar configuration. The first cleaning solution can be a diluted potassium peroxide solution, a saline, or any solution for dipping purposes.

Next, the lid 130 is applied to shield onto the top of the outer tank 110. The motor 160 is then activated and a rotational speed thereof is provided to rotate the pillared device 180 about the shaft 190. Hence, the pillared device 180 can react with the first cleaning solution for removing process particles adhere thereon. After cleaning the pillared device 180, the first cleaning solution in the inner tank 120 is discharged via the first outlet 120*d* and the conduit 120*e*. In the present invention, the first cleaning solution can be recycled for future usage.

Further, the nozzles 140 constructed in the interior of the lid 130 is turned on to spray a second cleaning solution directly onto the rotating pillared device 180 for diluting the first cleaning solution remaining thereon. In a preferred embodiment of the present invention, the second cleaning solution can be de-ioned water. It is noted that the outer tank 110 can be used for collecting the first and the second cleaning solutions splashing out of the inner tank 120.

By providing the present invention, following advantages are obvious.

1. Since a portion of the pillared device is immersed into the first cleaning solution in the inner tank and reacts therewith by a physical motion, e.g. turning, the amount of the first cleaning solution can be effectively saved.
2. In addition, the first cleaning solution can be recycled, and so the cost of the cleaning process can be reduced.
3. Further, because the rotational speed of the motor is adjustable, the cleaning performance can present a better control.
4. Moreover, the cost and the time for shutting down the facilities having the pillared device can be substantially reduced.

While the preferred embodiment of the invention has been illustrated and described, it is appreciated that various changes and modifications can be made therein without departing from the spirit and scope of the invention.

We claim:

1. A cleaning apparatus for a pillared device, comprising:

an outer tank, further including thereof opposing sidewalls respective upper edges, said upper edges further having respective openings to allow a shaft extending out from two ends of said pillared device to pass through;

an inner tank within said outer tank for containing said pillared device, supported upon a floor of said outer tank, at least enabling a portion of said pillared device to be immersed into a first cleaning solution contained in said inner tank;

a lid covering onto a top of said outer tank; and a plurality of nozzles constructed in an interior of said lid to spray a second cleaning solution onto said pillared device.

2. The cleaning apparatus of claim 1, wherein said pillared device is a roller.

3. The cleaning apparatus of claim 1, wherein said inner tank is a semi-cylindrical shell.

4. The cleaning apparatus of claim 3, wherein two ends of said semi-cylindrical shell are mounted to said opposing side-walls of said outer tank.

5. The cleaning apparatus of claim 1, wherein said first cleaning solution is a diluted potassium peroxide solution.

6. The cleaning apparatus of claim 1, wherein said second cleaning solution is a de-ioned water.

7. The cleaning apparatus of claim 1, wherein said pillared device is an optoelectrical device.

* * * * *